US008556382B2

(12) United States Patent
Kang

(10) Patent No.: US 8,556,382 B2
(45) Date of Patent: Oct. 15, 2013

(54) NOZZLE PLATE AND METHOD OF MANUFACTURING THE SAME

(75) Inventor: Sung-gyu Kang, Suwon-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 519 days.

(21) Appl. No.: 12/461,501

(22) Filed: Aug. 13, 2009

(65) Prior Publication Data

US 2010/0128088 A1 May 27, 2010

(30) Foreign Application Priority Data

Nov. 27, 2008 (KR) ..... 10-2008-0118810

(51) Int. Cl.
*B41J 2/14* (2006.01)
*B41J 2/16* (2006.01)

(52) U.S. Cl.
USPC ..... 347/47

(58) Field of Classification Search
USPC ..... 347/47
See application file for complete search history.

(56) References Cited

U.S. PATENT DOCUMENTS

| | | | | |
|---|---|---|---|---|
| 7,314,185 | B2 * | 1/2008 | Nishi et al. | 239/102.1 |
| 2001/0028378 | A1 * | 10/2001 | Lee et al. | 347/68 |
| 2006/0017782 | A1 * | 1/2006 | Nishi et al. | 347/55 |
| 2008/0111854 | A1 * | 5/2008 | Laffay et al. | 347/45 |
| 2009/0071937 | A1 | 3/2009 | Yamashita | |

FOREIGN PATENT DOCUMENTS

| | | | |
|---|---|---|---|
| CN | 1572504 | A | 2/2005 |
| JP | 5-229128 | | 9/1993 |
| JP | H08-72251 | A | 3/1996 |
| JP | H09-187944 | A | 7/1997 |
| JP | 11-010896 | | 1/1999 |
| JP | 2002-046276 | | 2/2002 |
| JP | 2002-370351 | A | 12/2002 |
| JP | 2003-311972 | | 11/2003 |
| JP | 2008-037004 | A | 2/2008 |
| JP | 2008-049673 | A | 3/2008 |
| JP | 2008-087284 | A | 4/2008 |
| KR | 10-2001-0084240 | | 9/2001 |
| KR | 10-2007-0043591 | | 4/2007 |
| KR | 10-2007-0060924 | | 6/2007 |

OTHER PUBLICATIONS

Chinese Office Action dated Jun. 5, 2013 for corresponding Chinese Application No. 200910220834.2.

* cited by examiner

*Primary Examiner* — Matthew Luu
*Assistant Examiner* — Renee I Wilson
(74) *Attorney, Agent, or Firm* — Harness, Dickey & Pierce, P.L.C.

(57) ABSTRACT

Provided are a nozzle plate and a method of fabricating the nozzle plate. In accordance with an example embodiment of the present invention, a nozzle plate may include a body and at least one nozzle protruding from the body, wherein the at least one nozzle includes a wall having a thickness that increases the farther the wall gets away from an exit of the at least one nozzle.

6 Claims, 15 Drawing Sheets

NOZZLE PLATE AND METHOD OF MANUFACTURING THE SAME

CROSS-REFERENCE TO RELATED APPLICATIONS

This application claims priority under 35 U.S.C. §119 to Korean Patent Application No. 10-2008-0118810, filed on Nov. 27, 2008, in the Korean Intellectual Property Office (KIPO), the entire contents of which are herein incorporated by reference.

BACKGROUND

1. Field

Example embodiments of the present invention relate to a nozzle plate including a protrusion type nozzle and a method of fabricating the nozzle plate.

2. Description of the Related Art

Inkjet printing involves ejecting fine droplets of ink onto a printing medium using nozzles formed in a nozzle plate. Inkjet printing may be used to print a predetermined image by ejecting the fine droplets onto desired portions of the printing medium.

Inkjet printing technology may be applied in various fields of printable electronics, biotechnology, and bioscience, as well as in the image printing field. For example, a flexible substrate, besides a glass substrate, may be used to fabricate electronic circuits, and thus, the inkjet printing technology may be applied in the field of flexible display apparatuses. According to inkjet printing, a pattern may be formed by just one process, and thus, processing costs may be lower than that of a conventional photolithography process.

Inkjet printing technology may be classified into thermal type printing technology and piezoelectric type printing technology. In the thermal type printing technology, bubbles may be generated using a heat source and droplets may be ejected using an expansion property of the bubbles. The piezoelectric type printing technology ejects the droplets using a transformation of piezoelectric material.

Electro-hydrodynamic type printing technology ejects droplets of ink by using an electrostatic force. The electro-hydrodynamic type printing technology has an advantage that a volume of an ejected droplet may be greatly reduced when compared with the conventional thermal type and the conventional piezoelectric type printing technologies.

SUMMARY

Example embodiments of the present invention include a nozzle plate having protruding nozzles and a method of fabricating the nozzle plate.

Additional aspects will be set forth in part in the description which follows and, in part, will be apparent from the description, or may be learned by practice of the invention.

In accordance with an example embodiment of the present invention, a nozzle plate may include a body and at least one nozzle protruding from the body, wherein the at least one nozzle includes a wall having a thickness that increases the farther the wall gets away from an exit of the at least one nozzle.

In accordance with an example embodiment of the present invention, a method of fabricating a nozzle plate may include forming a first etching mask on a lower surface of a substrate, etching the lower surface of the substrate using the first etching mask to form a lower portion of a nozzle, forming a second etching mask having an island pattern on an upper surface of the substrate, wet-etching the upper surface of the substrate using the second etching mask to form an island on the upper surface of the substrate, forming a third etching mask on the substrate, and etching an upper surface of the island using the third etching mask to form an upper portion of the nozzle, wherein the nozzle has a wall with a thickness that increases the farther the wall gets from an exit of the nozzle.

To achieve the above and/or other aspects, example embodiments of the present invention may include a nozzle plate including a body and nozzles protruding from the body, wherein each of the nozzles includes a wall, a thickness of which is increased gradually the farther it gets from an exit of the nozzle.

A lower portion of the nozzle may have a cross-sectional area that decreases gradually toward the exit of the nozzle, and an upper portion of the nozzle may have a constant cross-sectional area and extends from the lower portion of the nozzle toward the exit of the nozzle.

An inner wall of the lower portion of the nozzle may be inclined at a predetermined or preset angle with respect to a surface of the body, and an outer wall of the nozzle may be inclined at an angle with respect to the surface of the body, wherein the angle formed by the outer wall and the surface of the body is smaller than an angle formed by the inner wall of the lower portion of the nozzle and the surface of the body.

The body may be formed of silicon with <100> crystal direction. The inner wall of the lower portion of the nozzle may include four (111) crystal planes that are inclined at an angle about 54.7° with respect to a (100) crystal plane.

The lower portion and the upper portion of the nozzle may respectively include constant cross-sectional areas, and the cross-sectional area of the upper portion of the nozzle may be smaller than the cross-sectional area of the lower portion of the nozzle. An outer wall of the nozzle may be inclined at a predetermined angle with respect to the surface of the body.

An inner wall of the nozzle may have a circular cross-section or a polygonal cross-section. An outer wall of the nozzle may have a circular cross-section or a polygonal cross-section.

The nozzle plate may further include protrusion portions formed on both sides of the body.

To achieve the above and/or other aspects, example embodiments of the present invention may include a method of fabricating a nozzle plate. The method may include forming a first etching mask for forming a lower portion of a nozzle on a lower surface of a substrate, etching the lower surface of the substrate by using the first etching mask in an anisotropic manner to form the lower portion of the nozzle, forming a second etching mask having an island pattern on an upper surface of the substrate, wet-etching the upper surface of the substrate by using the second etching mask in an anisotropic manner to form an island on the upper surface of the substrate, forming a third etching mask on the substrate for forming an upper portion of the nozzle, and etching an upper surface of the island by using the third etching mask in the anisotropic manner to form the upper portion of the nozzle, wherein the nozzle has a wall, a thickness of which gradually increases the farther it gets from an exit of the nozzle.

The upper portion of the nozzle may be formed by anisotropic dry etching to have a constant cross-sectional area along a lengthwise direction of the nozzle.

The lower portion of the nozzle may have a cross-sectional area that decreases gradually toward the upper portion of the nozzle due to the anisotropic wet etching. An inner wall of the lower portion of the nozzle may be inclined at a predetermined or preset angle with respect to the lower surface of the substrate, and an outer wall of the nozzle may be inclined at an angle with respect to the lower surface of the substrate, wherein the angle formed by the outer wall and the lower surface of the substrate is smaller than an angle formed by the inner wall of the lower portion of the nozzle and the lower surface of the substrate.

The lower portion of the nozzle may be formed by anisotropic dry etching to have a constant cross-sectional area along a lengthwise direction of the nozzle.

The second etching mask may include protrusion patterns, and the method may further include forming protrusion portions on both sides of the substrate by using the protrusion patterns.

BRIEF DESCRIPTION OF THE DRAWINGS

These and/or other aspects will become apparent and more readily appreciated from the following description of the example embodiments of the present invention, taken in conjunction with the accompanying drawings of which.

DETAILED DESCRIPTION

Figure 1:
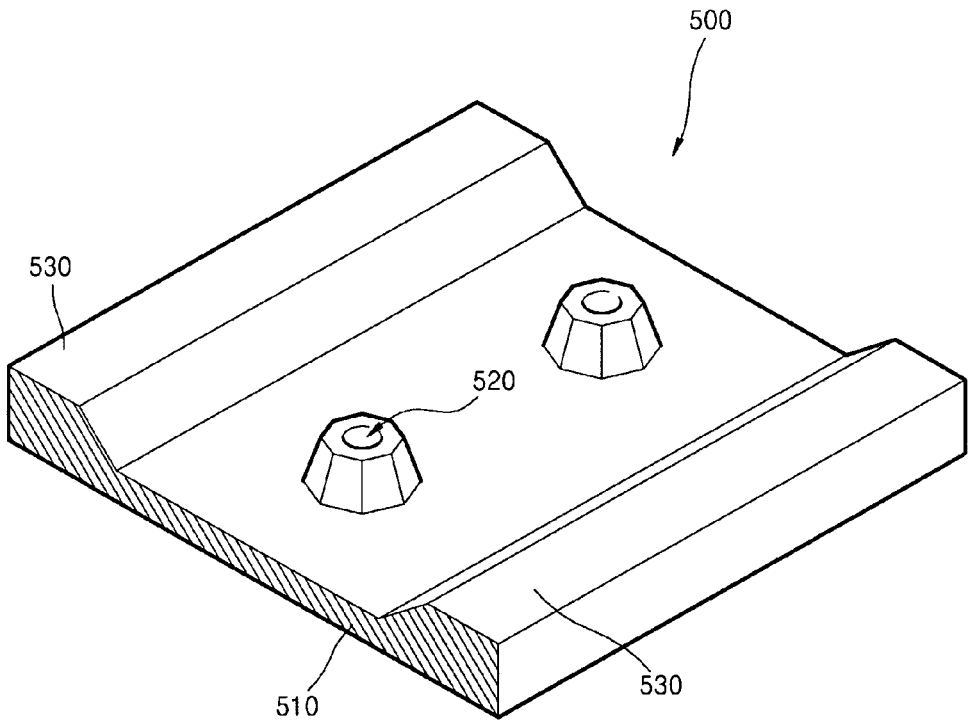
FIG. 1 is a schematic perspective view of part of a nozzle plate according to an example embodiment of the present invention.

Example embodiments of the present invention will now be described more fully with reference to the accompanying drawings, in which example embodiments are shown. The invention may, however, be embodied in different forms and should not be construed as limited to the example embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on", "connected to", or "coupled to" another element or layer, it can be directly on, connected to, or coupled to the other element or layer or intervening elements or layers that may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section without departing from the teachings of example embodiments.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Example embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configuration formed on the basis of manufacturing processes. Therefore, regions exemplified in figures have schematic properties and shapes of regions shown in figures exemplify specific shapes or regions of elements, and do not limit example embodiments.

Reference will now be made in detail to example embodiments of the present invention, examples of which are illustrated in the accompanying drawings, wherein like reference numerals refer to the like elements throughout. In this regard, the example embodiments of the present invention may have different forms and should not be construed as being limited to the descriptions set forth herein. Accordingly, the example embodiments of the present invention are merely described below, by referring to the figures, to explain aspects of the present description.

Figure 2:
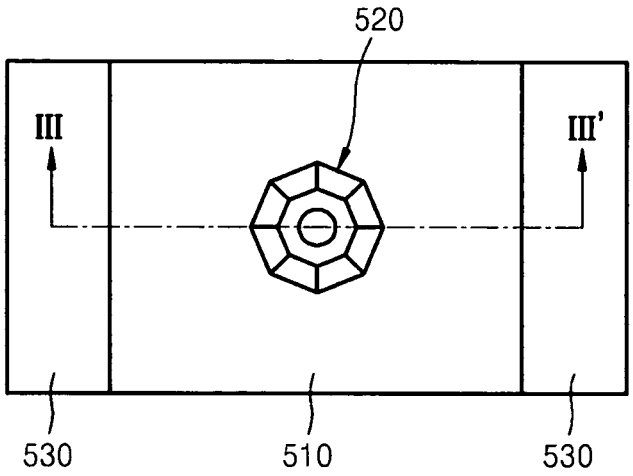
FIG. 2 is a plan view of the nozzle plate shown in FIG. 1.
Figure 3:
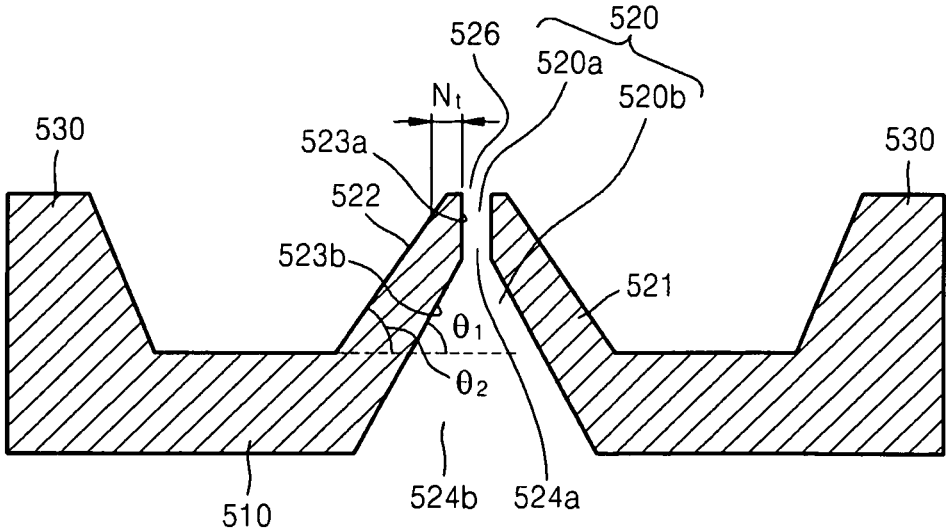
FIG. 3 is a cross-sectional view of the nozzle plate taken along line III-III' of FIG. 2.
Figure 4A:
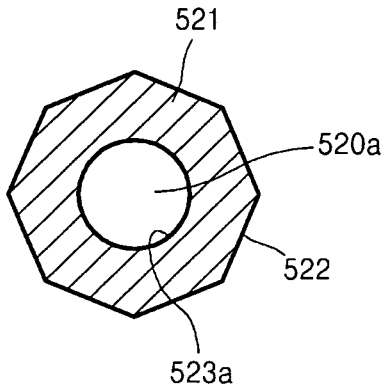
FIG. 4A is a cross-sectional view of an upper part of a nozzle formed in the nozzle plate shown in FIG. 1.
Figure 4B:
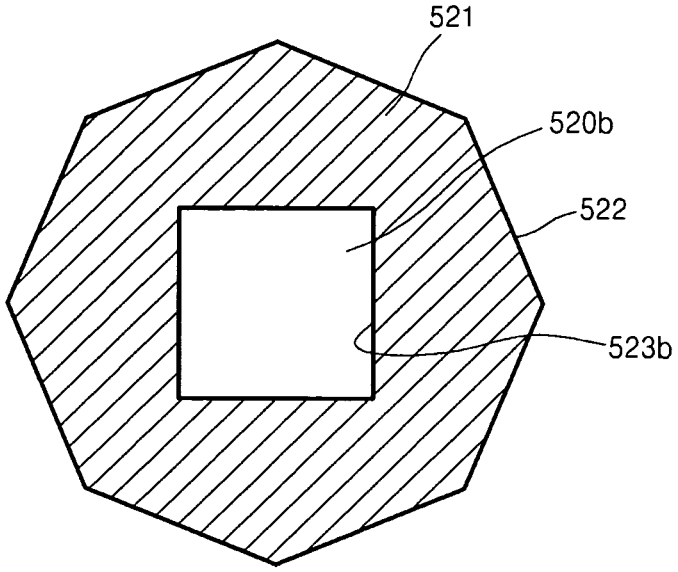
FIG. 4B is a cross-sectional view of a lower part of the nozzle formed in the nozzle plate shown in FIG. 1.

FIG. 1 is a schematic perspective view of part of a nozzle plate according to an example embodiment of the present invention, FIG. 2 is a plan view of the nozzle plate shown in FIG. 1, and FIG. 3 is a cross-sectional view of the nozzle plate taken along line III-III' of FIG. 2. FIG. 4A is a cross-sectional view of an upper part of a nozzle formed in the nozzle plate shown in FIG. 1, and FIG. 4B is a cross-sectional view of a lower part of the nozzle formed in the nozzle plate shown in FIG. 1.

Referring to FIGS. 1 through 4B, a nozzle plate 500, according to an example embodiment of the present invention, may include a body 510, and a plurality of nozzles 520 protruding from the body 510. A thickness $N_r$ of a nozzle wall 521 may gradually increase the farther the nozzle wall 521 gets from an exit 526 of the nozzle 520. In addition, protrusion portions 530 may be formed on both sides of the body 510 in order to protect the nozzles 520.

A lower portion 520*b* of the nozzle 520 may enclose a space 524*b* that has a cross-sectional area that gradually reduces toward the exit 526 of the nozzle 520. An inner wall 523*b* of the lower portion 520*b* of the nozzle 520 may have a rectangular cross-section as shown in FIG. 4B. However, the example embodiment of the present invention is not limited to the above example, and the inner wall 523*b* of the lower portion 520*b* of the nozzle 520 may have a circular cross-section or polygonal cross-section. The inner wall 523*b* may be formed to be inclined at a predetermined or preset angle ($\theta_1$) with respect to a surface of the body 510. For example, when the body 510 is formed of silicon of <100> crystal direction, the inner wall 523*b* of the nozzle lower portion 520*b* may be formed of four (111) crystal planes that are inclined at an angle of about 54.7° with respect to a (100) crystal plane. An upper portion 520*a* of the nozzle 520 may extend from the lower portion 520*b* toward the exit 526 of the nozzle 520. As shown in FIG. 3, the upper portion 520*a* of the nozzle 520 may enclose a space 524*a* that has a constant cross-section. An inner wall 523*a* of the upper portion 520*a* may have a circular cross-section as shown in FIG. 4A. However, the example embodiment of the present invention is not limited to the above example, for example, the inner wall 523*a* of the upper portion 520*a* of the nozzle 520 may have various polygonal cross-sections.

An outer wall 522 of the nozzle 520 may be formed to be inclined at a predetermined or preset angle ($\theta_2$) with respect to the surface of the body 510. The outer wall 522 of the nozzle 520 may have an octagonal cross-section as shown in FIGS. 4A and 4B. However, the example embodiment of the present invention is not limited to the above example, and the outer wall 522 of the nozzle 520 may have a circular cross-section or various polygonal cross-sections. The angle $\theta_2$ of the outer wall 522 may be smaller than the angle ($\theta_1$) of the inner wall 523*b* of the lower portion 520*b*. Accordingly, a thickness of the nozzle wall 521 may increase gradually the farther it gets from the exit 526 of the nozzle 520. As described above, the thickness of the nozzle wall 521 may increase from the exit 526 of the nozzle 520, therefore, a relatively strong nozzle structure may be obtained, and thus, a reliable nozzle plate 500 may be formed. Although it is not shown in the above-mentioned drawings, an oxide layer 206, for example, a silicon oxide layer, may be formed on an entire surface of the nozzle plate 500 including the inner walls 523*a* and 523*b* of the nozzle 520, as shown in FIG. 14.

Figure 5:
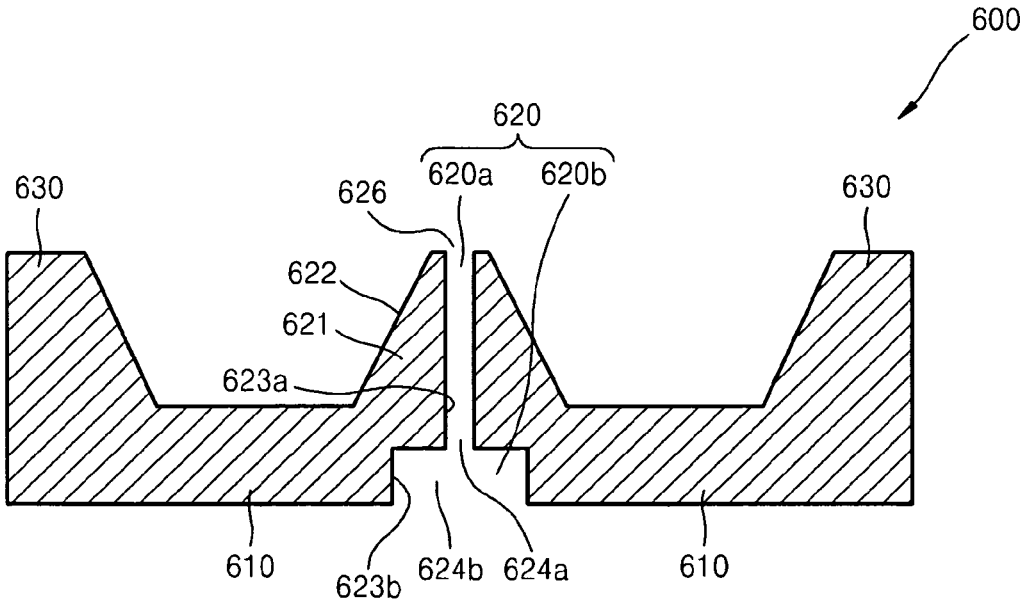
FIG. 5 is a cross-sectional view of a nozzle plate according to another example embodiment of the present invention.

FIG. 5 is a cross-sectional view of a nozzle plate according to another example embodiment of the present invention.

Referring to FIG. 5, a nozzle plate 600, according an example embodiment of the present invention, may include a body 610 and a plurality of nozzles 620 protruding from the body 610. A thickness of a nozzle wall 621 may be increased when it is apart from the exit 626 of the nozzle 620. In addition, protrusion portions 630 may be formed on both sides of the body 610 in order to protect the nozzles 620. A lower portion 620*b* of the nozzle 620 may enclose a space 624*b* that has a constant cross-section. An inner wall 623*b* of the lower portion 620*b* may have a circular or polygonal cross-section. An upper portion 620*a* of the nozzle 620 may enclose a space 624*a* that has a constant cross-section. As shown in FIG. 5, the cross-sectional area of the upper portion 620*a* of the nozzle 620 may be smaller than that of the lower portion 620*b* of the nozzle 620. An inner wall 623*a* of the upper portion 620*a* may have a circular or polygonal cross-section.

An outer wall 622 of the nozzle 620 may be inclined at a predetermined or preset angle with respect to a surface of the body 610. Accordingly, a thickness of the nozzle wall 621 may increase gradually the farther the nozzle wall 621 gets from the exit 626 of the nozzle 620. The outer wall 622 of the nozzle 620 may have a circular or polygonal cross-section.

Hereinafter, a method of fabricating the nozzle plate according to the example embodiment of the present invention shown in FIG. 1, will be described. FIGS. 6A through 14B are diagrams illustrating processes of fabricating the nozzle plate shown in FIG. 1.

Figure 6A:
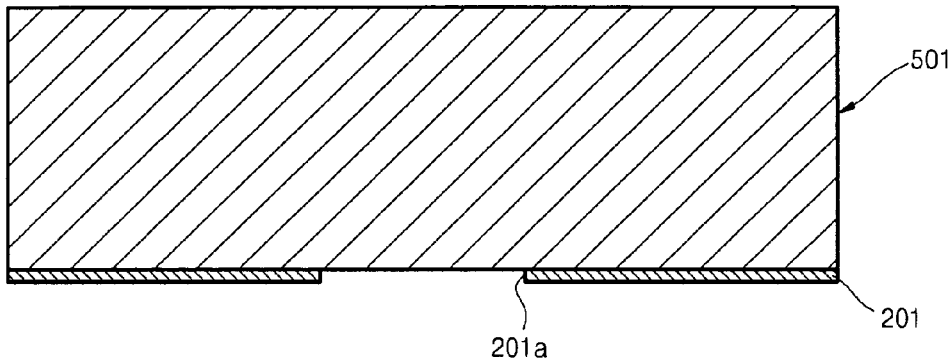
FIGS. 6A through 14B are diagrams illustrating processes of fabricating the nozzle plate shown in FIG. 1.
Figure 6B:
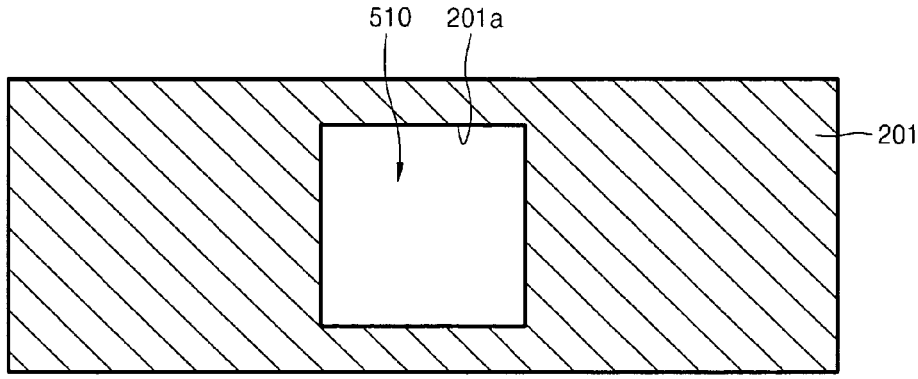

FIGS. 6A and 6B are a cross-sectional view and a bottom view showing a first etching mask 201 formed on a lower surface of a substrate 501. The substrate 501 may be a silicon substrate, for example, a silicon substrate with <100> direction. However, the example embodiment of the present invention is not limited to the above example. The first etching mask 201 may have a through hole 201 a to expose a lower portion of a nozzle that may be formed on the lower surface of the substrate 501. The first etching mask 201 may be formed by forming an oxide layer, for example, a silicon oxide layer, on the lower surface of the substrate 501, and patterning the oxide layer.

Figure 7A:
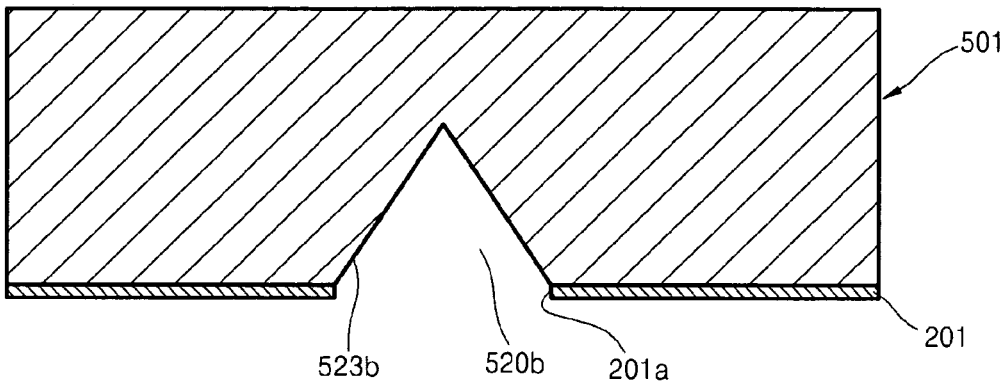
Figure 7B:
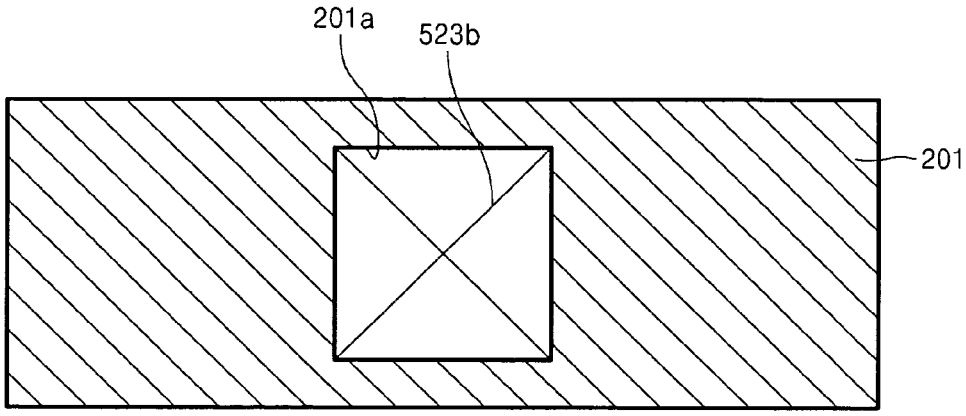
Figure 8:
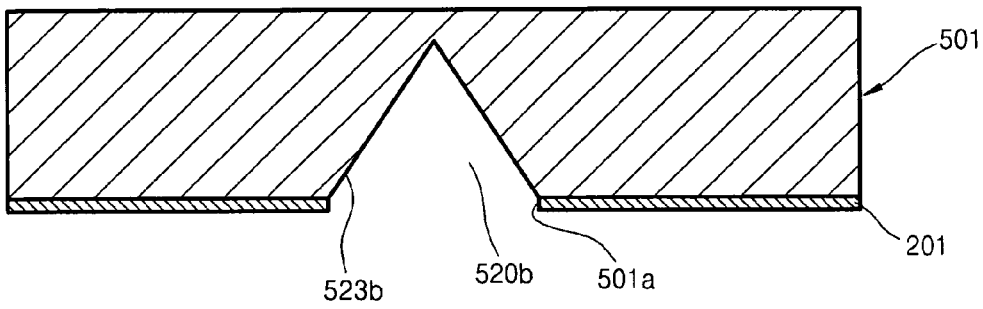

FIGS. 7A and 7B are a cross-sectional view and a bottom view showing that the lower portion 520*b* of the nozzle may be formed by etching the lower surface of the substrate 501. Referring to FIGS. 7A and 7B, the bottom surface of the substrate 501 may be etched using an anisotropic wet etching process to form the lower portion 520*b* of the nozzle. Trimethylammonium hydroxide (TMAH) solution or potassium hydroxide (KOH) solution may be used as an etchant. However, the example embodiment of the present invention is not limited to the above example. Due to the anisotropic wet etching, the lower portion 520*b* of the nozzle may be formed to enclose a space having a cross-sectional area that gradually reduces toward an upper portion of the substrate 501. Accordingly, the inner wall 523*b* of the lower portion 520*b* of the nozzle may be formed to be inclined at a predetermined or given angle with respect to the substrate 501. The inner wall 523*b* may have the circular or polygonal cross-section. For example, when a silicon substrate with <100> crystal direction is used as the substrate 501, the inner wall 523*b* of the lower portion 520*b* may be formed of four (111) crystal planes that may be inclined at about 54.7° with respect to a (100) crystal plane. As shown in FIG. 8, the substrate 501 may be processed to a desired thickness to correspond to a length of the upper portion (520*a* of FIG. 14A) of the nozzle.

Figure 9A:
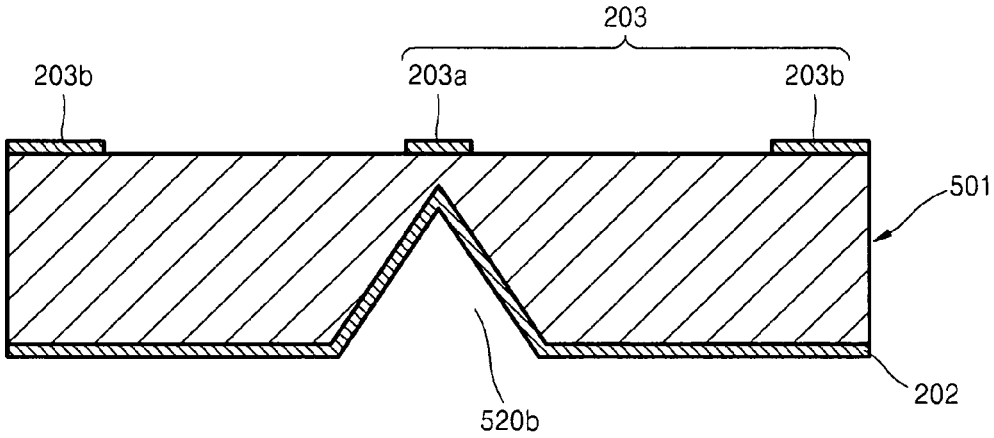
Figure 9B:
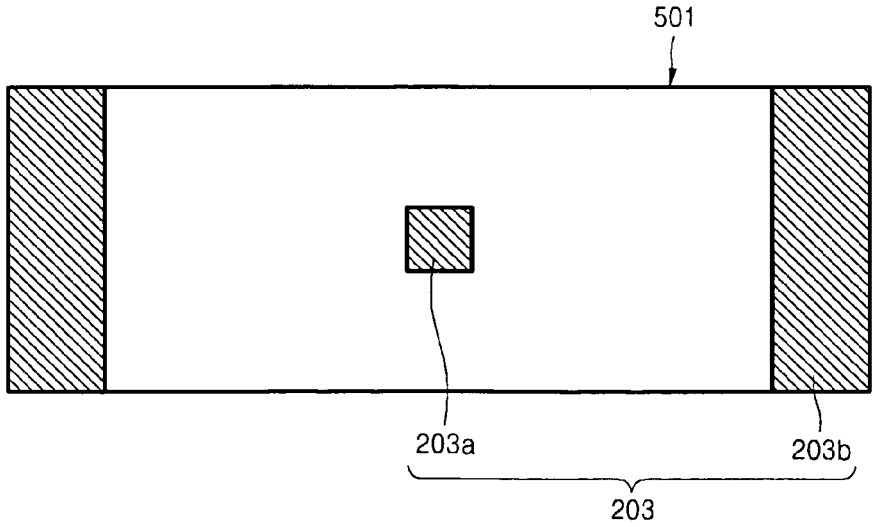

FIGS. 9A and 9B are a cross-sectional view and a plan view showing that a second etching mask 203 may be formed on an upper surface of the substrate 501, in which the lower portion 520*b* of the nozzle is formed. Referring to FIGS. 9A and 9B, the second etching mask 203 having an island pattern 203*a* corresponding to the nozzle (520 of FIG. 14A) may be formed on the upper surface of the substrate 501. The second etching mask 203 may further include protrusion patterns 203*b* corresponding to protrusion portions (530 of FIG. 14A) that will be described later. The second etching mask 203 may be formed by forming an oxide layer, for example, a silicon oxide layer, on the entire surface of the substrate 501, in which the lower portion 520*b* of the nozzle 520 is formed, and by patterning the oxide layer formed on the upper surface of the substrate 501. In this process, an oxide layer 202 may be formed on the lower surface of the substrate 501, in which the lower portion 520*b* of the nozzle 520 is formed.

Figure 10A:
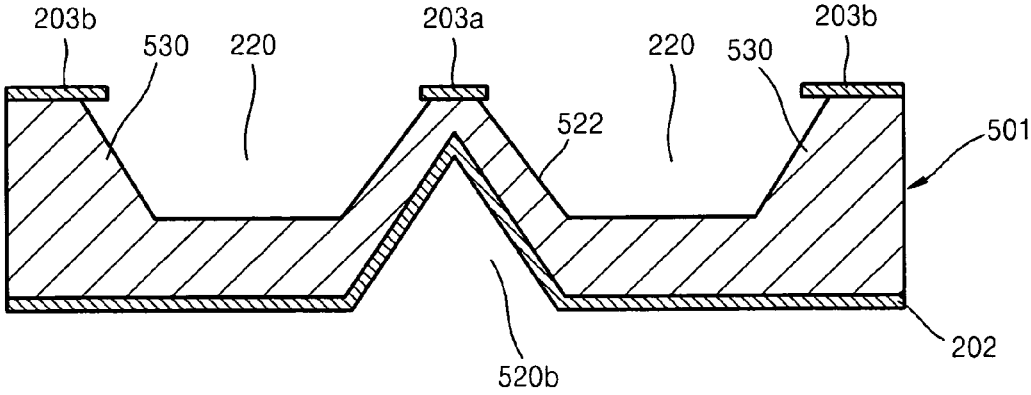
Figure 10B:
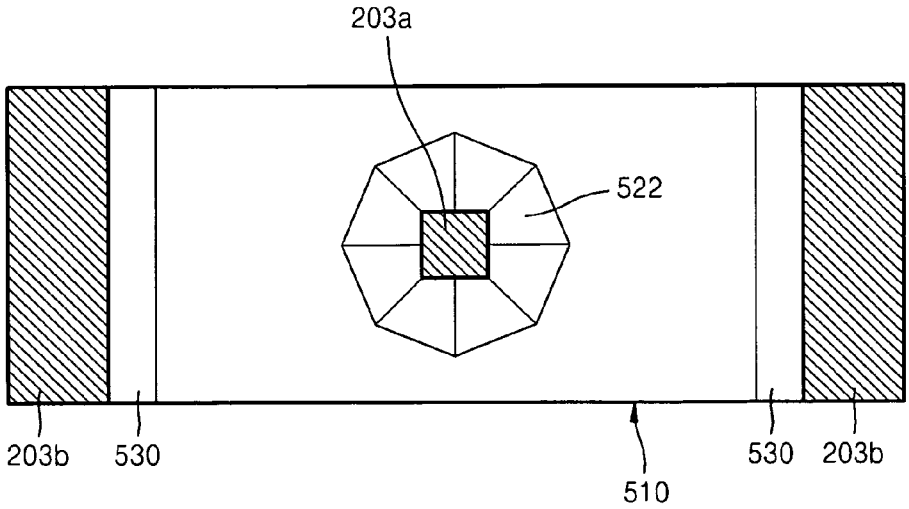

FIGS. 10A and 10B are a cross-sectional view and a plan view showing the outer wall 522 of the nozzle 520 that may be formed by etching the upper surface of the substrate 501. Referring to FIGS. 10A and 10B, the upper surface of the substrate 501 may be etched using the second etching mask 203 in the anisotropic wet etching method. The wet etching method may form a protruded island on the upper surface of the substrate 501 due to the island pattern 203*a*, and a trench 220 around the island. In addition, the protrusion portions 530 may be formed on both sides of the substrate 501 due to the protrusion patterns 203*b*. The TMAH solution or the KOH solution may be used as the etchant. However, the example embodiment of the present invention is not limited to the above example.

Due to the anisotropic wet etching process, the outer wall 522 of the nozzle 520 may be inclined at a predetermined or preset angle with respect to the lower surface of the substrate 501 or a bottom surface of the trench 220. The outer wall 522 of the nozzle 520 may be inclined at an angle that may be smaller than that of the inner wall 523*b* of the lower portion 520*b* of the nozzle 520 with respect to the lower surface of the substrate 501. Accordingly, the thickness of the nozzle wall 521 may increase gradually the farther the nozzle wall 521 gets away from the exit 526 of the nozzle 520. For example, when the silicon substrate with <100> crystal direction is used as the substrate 501, the outer wall 522 of the nozzle 520 may be inclined at an angle about 43°-45° with respect to the (100) crystal plane. In FIG. 10B, the silicon substrate with <100> crystal direction may be used as the substrate 501 and the outer wall 522 of the nozzle 520 may include eight crystal planes. However, the example embodiment of the present invention is not limited to the above example. The outer wall 522 of the nozzle 520 may have the circular cross-section or a polygonal cross-section. In addition, the oxide layer 202 and the second etching mask 203 that may be formed on the substrate 501 may be removed.

Figure 11:
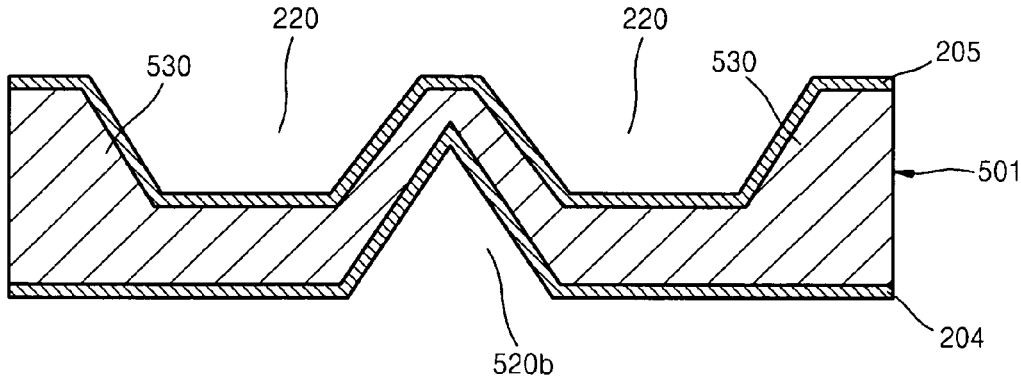
Figure 12:
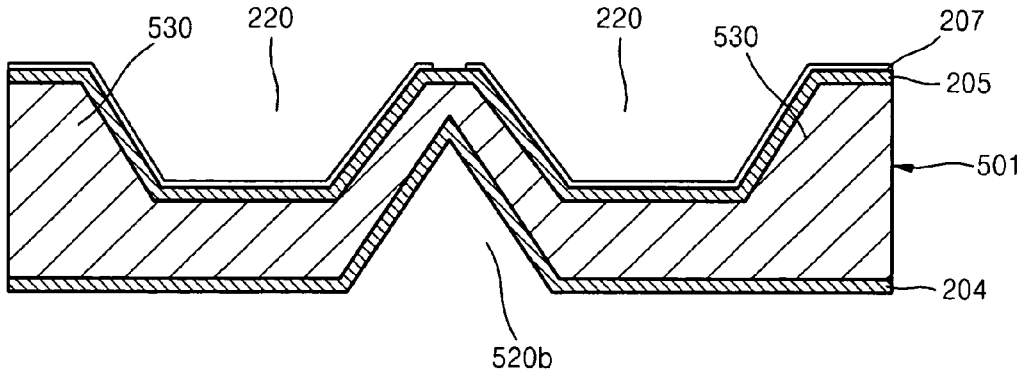

FIG. 11 is a cross-sectional view of the substrate 501, on which an oxide layer may be formed to cover the entire surface thereof. Referring to FIG. 11, predetermined oxide layers 204 and 205, for example, silicon oxide layers, may be formed on the entire surface of the substrate 501. FIG. 12 is a cross-sectional view showing the substrate 501, on which a third etching mask 207 for forming the upper portion 520*a* of the nozzle 520 may be formed. Referring to FIG. 12, the third etching mask 207, including a through hole that exposes the upper portion of the nozzle, may be formed on the oxide layer 205 that may be formed on the upper surface of the substrate 501.

The third etching mask 207 may be formed by applying a photoresist on the oxide layer 205 that may be formed on the upper surface of the substrate 501, and by patterning the photoresist. The photoresist may be applied by a spray coater, for example. However, the example embodiment of the present invention is not limited to the above example.

Figure 13:
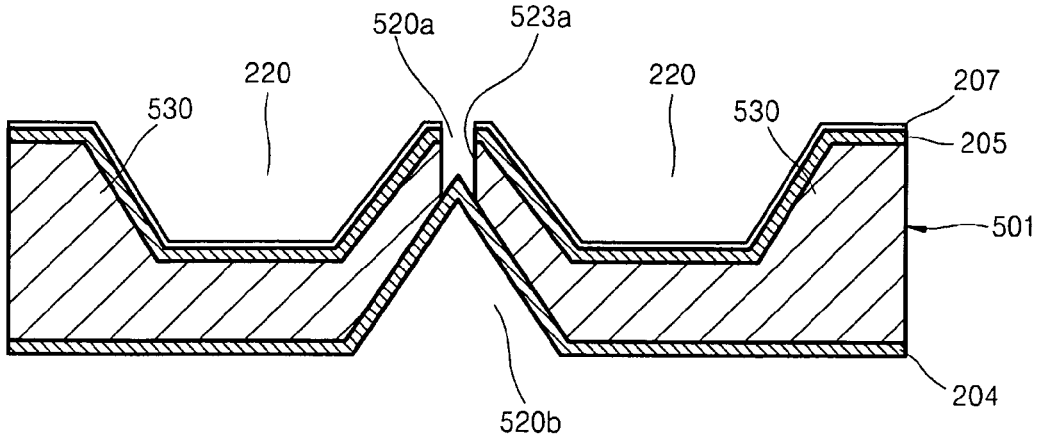

FIG. 13 is a cross-sectional view of the substrate 501, in which the upper portion 520*a* of the nozzle 520 may be formed. Referring to FIG. 13, the oxide layer 205 formed on the island and the substrate 501 may be etched using the third etching mask 207 in an anisotropic dry etching method to form the upper portion 520*a* of the nozzle 520. The anisotropic dry etching method may be an inductively coupled plasma-reactive ion etching (ICP-RIE) method. However, the example embodiment of the present invention is not limited to the above example. The upper portion 520*a* may enclose a space having a constant cross-sectional area formed by the anisotropic dry etching process. The inner wall 523*a* of the upper portion 520*a* may have the circular cross-sectional or the polygonal cross-section. In addition, the third etching mask 207 and the oxide layers 204 and 205 may be removed. Accordingly, the lower portion 520*b* and the upper portion 520*a* of the nozzle 520 may be connected to each other to complete the nozzle 520.

Figure 14A:
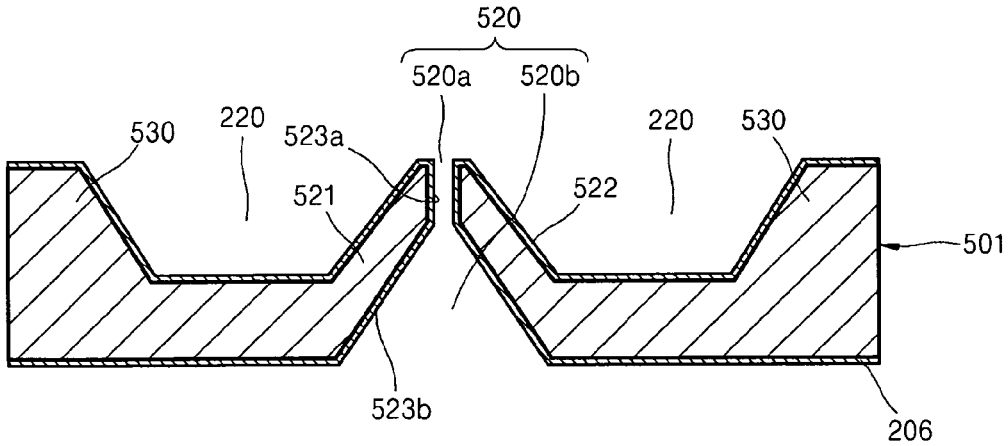
Figure 14B:
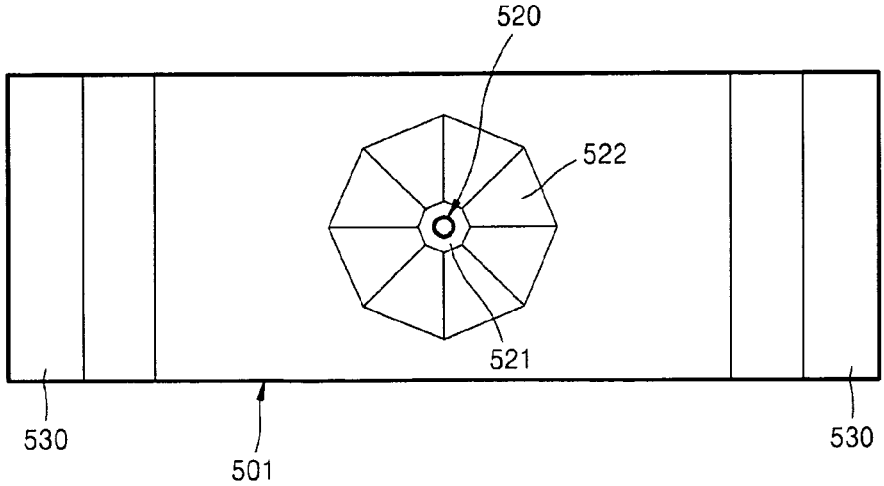

FIGS. 14A and 14B are a cross-sectional view and a plan view showing the substrate 501, on which an oxide layer 206, for example, a silicon oxide layer, may be formed to cover the entire surface thereof. Referring to FIGS. 14A and 14B, the substrate 501 may be a silicon substrate and the oxide layer 206 may be further formed on the entire surface of the substrate 501 including the inner walls 523*a* and 523*b* of the nozzle 520. Accordingly, the nozzle plate of the example embodiment of the present invention may be formed.

FIGS. 15 through 21 are diagrams illustrating processes of fabricating the nozzle plate shown in FIG. 5. Hereinafter, elements of the nozzle plate that are different from the above embodiment described in relation to FIG. 1, will be described.

Figure 15:
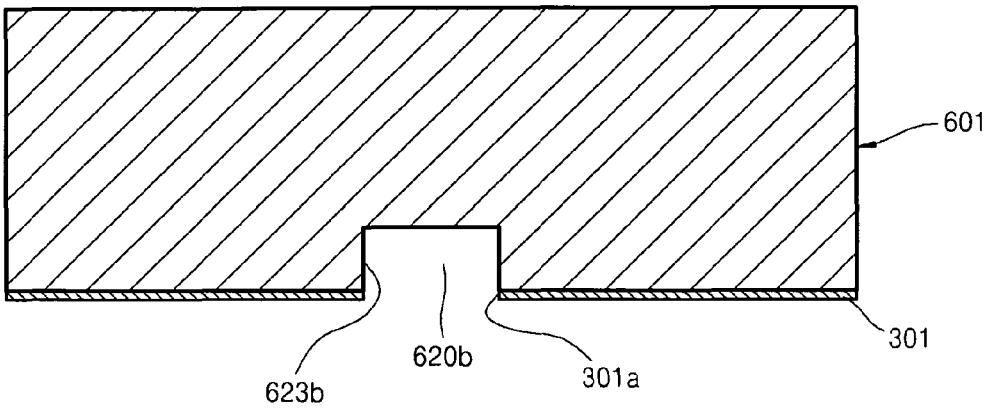
FIGS. 15 through 21 are diagrams illustrating processes of fabricating the nozzle plate shown in FIG. 5.
Figure 16:
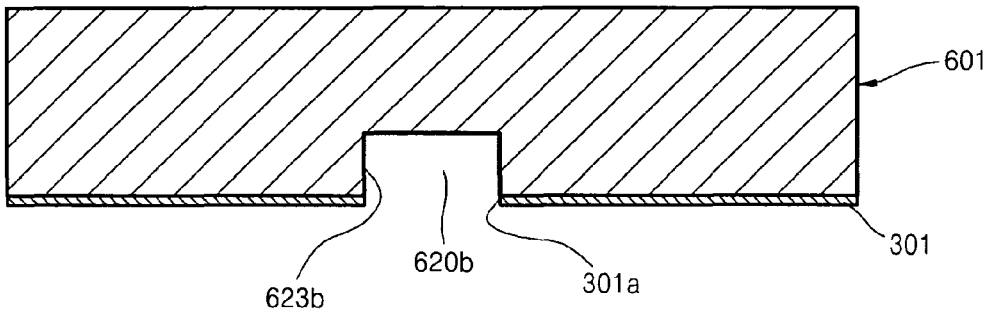

FIG. 15 is a cross-sectional view showing a substrate 601, in which the lower portion 620*b* of a nozzle may be formed. Referring to FIG. 15, the substrate 601 may be prepared and a first etching mask 301 having a through hole 301 a configured to expose the lower portion of the nozzle may be formed on the lower surface of the substrate 601. The substrate 601 may be a silicon substrate. In addition, the first etching mask 301 may be formed by forming a predetermined or given oxide layer, for example, a silicon oxide layer, on the lower surface of the substrate 601, and by patterning the oxide layer. The lower surface of the substrate 601 may be etched using the first etching mask 301 in the anisotropic dry etching method to form the lower portion 620*b* of the nozzle. The anisotropic dry etching method may be the ICP-RIE method. According to the anisotropic dry etching process, the lower portion 620*b* may be formed to enclose a space having a constant cross-sectional area. As shown in FIG. 16, the substrate 601 may be processed to a desired thickness so as to correspond to a length of the upper portion (620*a* of FIG. 21) of the nozzle.

Figure 17:
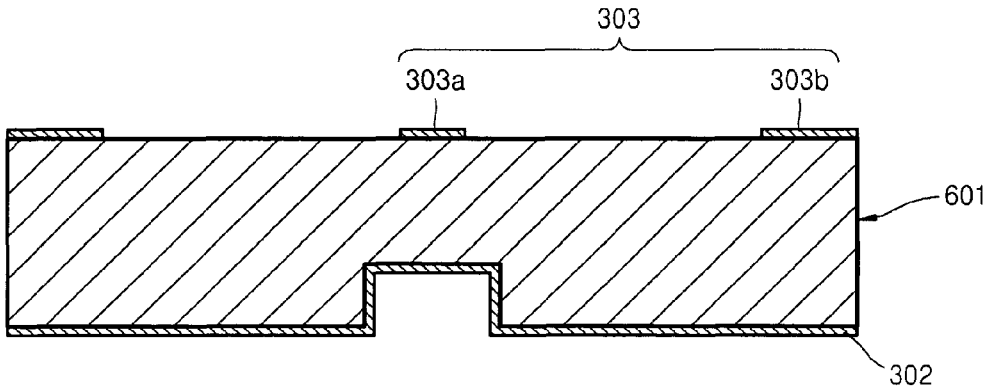

FIG. 17 is a cross-sectional view showing a second etching mask 303 that may be formed on the substrate 601, in which the lower portion 620*b* of the nozzle may be formed. Referring to FIG. 17, the second etching mask 303 having an island pattern 303*a* corresponding to the nozzle (620 of FIG. 21) may be formed on the upper surface of the substrate 601. The second etching mask 303 may further include protrusion patterns 303*b* that correspond to the protrusion portions (630 of FIG. 21) that will be described later. The second etching mask 303 may be formed by forming a predetermined or given oxide layer, for example, a silicon oxide layer, on the entire surface of the substrate 601, in which the lower portion 620*b* of the nozzle 620 may be formed, and by patterning the oxide layer formed on the upper surface of the substrate 601. In this process, an oxide layer 302 may be formed on the lower surface of the substrate 601, in which the lower portion 620*b* of the nozzle 620 may be formed.

Figure 18:
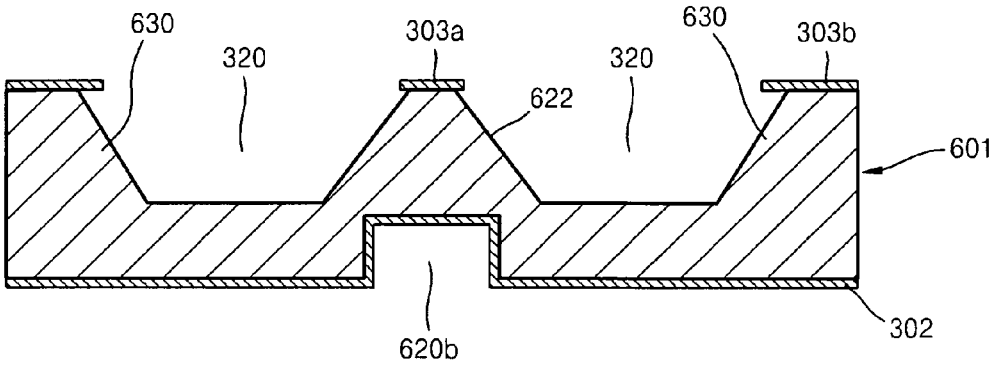

FIG. 18 is a cross-sectional view showing that the outer wall 622 of the nozzle 620 may be formed by etching the upper surface of the substrate 601. Referring to FIG. 18, the upper surface of the substrate 601 may be etched using the second etching mask 303 to a predetermined or preset depth by performing the anisotropic wet etching method, and a protruding island may be formed on the upper surface of the substrate 601 due to the island pattern 303*a*, and a trench 320 may be formed around the island. In addition, the protrusion portions 630 may be formed on both sides of the substrate 601 due to the protrusion patterns 303*b*. The TMAH solution or the KOH solution may be used as an etchant, however, the example embodiment of the present invention is not limited to the above example. According to the anisotropic wet etching process, the outer wall 622 of the nozzle 620 may be formed to be inclined at a predetermined or preset angle with respect to the lower surface of the substrate 601 or a bottom surface of the trench 320. The outer wall 622 of the nozzle 620 may have a circular cross-section or a polygonal cross-section. In addition, the oxide layer 302 and the second etching mask 303 formed on the substrate 601 may be removed.

Figure 19:
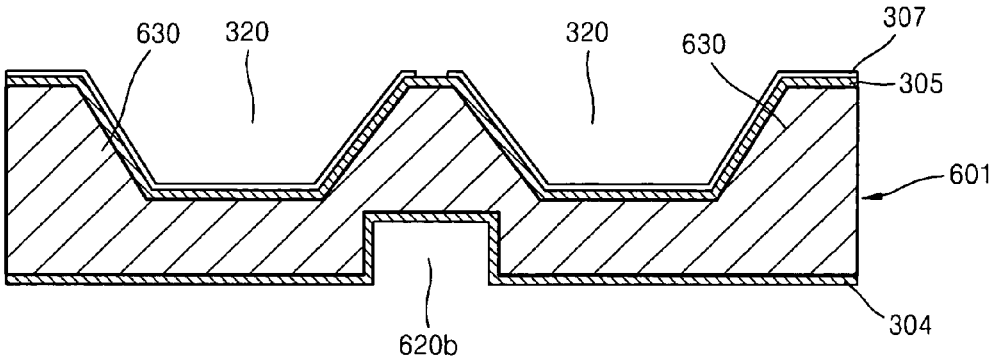

FIG. 19 is a cross-sectional view showing the substrate 601, on which a third etching mask 307 may be formed. Referring to FIG. 19, predetermined or given oxide layers 304 and 305, for example, silicon oxide layers, may be formed on the entire surface of the substrate 601. In addition, the third etching mask 307 having a through hole that exposes the upper portion of the nozzle may be formed on the oxide layer 305, which may be formed on the upper surface of the substrate 601. The third etching mask 307 may be formed by applying a photoresist on the oxide layer 305 and by patterning the photoresist layer. The photoresist may be applied by a spray coater, for example. However, the example embodiment of the present invention is not limited to the above example.

Figure 20:
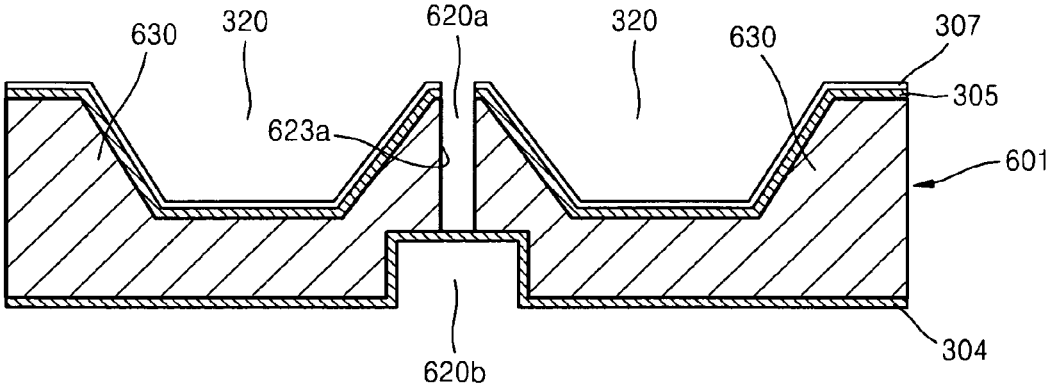

FIG. 20 is a cross-sectional view showing the substrate 601, in which the upper portion 620*a* of the nozzle 620 may be formed. Referring to FIG. 20, the oxide layer 305 that may be formed on the island and the substrate 601 may be etched using the third etching mask 307 by performing the anisotropic dry etching method, and the upper portion 620*a* of the nozzle 620 may be formed. The anisotropic dry etching method may be an ICP-RIE method. However, the example embodiment of the present invention is not limited to the above example. The nozzle portion 620*a* may be formed to enclose a space having a constant cross-sectional area due to the anisotropic dry etching process. The upper portion 620*a* of the nozzle 620 may have a cross-sectional area that may be smaller than that of the lower portion 620*b* of the nozzle 620. In addition, the inner wall 623*a* of the upper portion 620*a* may have a circular cross-section or a polygonal cross-section. The third etching mask 307 and the oxide layers 304 and 305 may be removed. Accordingly, the lower portion 620*b* and the upper portion 620*a* of the nozzle 620 may be connected to each other to form the nozzle 620.

Figure 21:
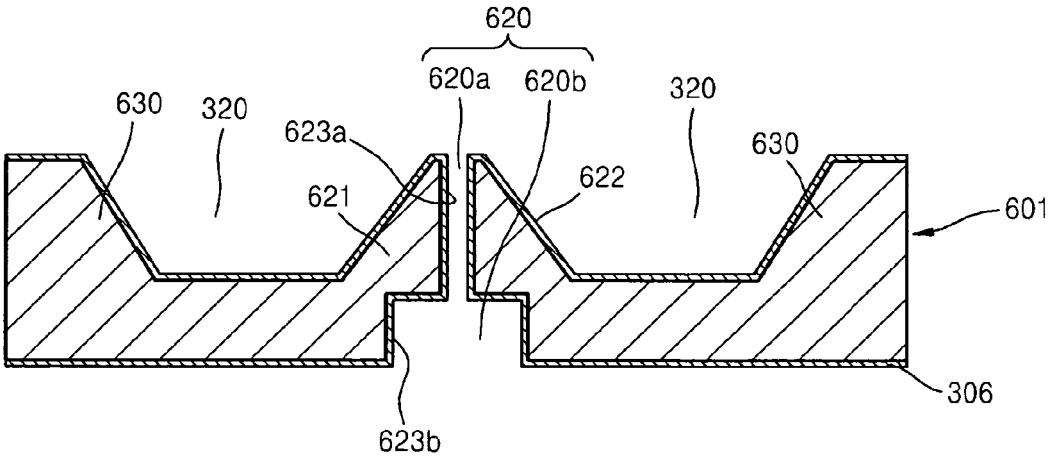

FIG. 21 is a cross-sectional view showing the substrate 601, on which an oxide layer 306 may be formed to cover the entire surface thereof. Referring to FIG. 21, the substrate 601 may be a silicon substrate and the predetermined or given oxide layer 306, for example, a silicon oxide layer, may be formed on the entire surface of the substrate 601 including the inner walls 623*a* and 623*b* of the nozzle 620.

According to the example embodiments of the present invention, the thickness of the nozzle wall may increase from the exit of the nozzle resulting in a relatively strong nozzle structure.

It should be understood that the example embodiments of the present invention described herein should be considered in a descriptive sense only and not for purposes of limitation. Descriptions of features or aspects within each example embodiment of the present invention should typically be considered as available for other similar features or aspects in other example embodiments.

What is claimed is:

1. A nozzle plate comprising:

a body; and at least one nozzle protruding from the body, wherein the at least one nozzle includes a wall having a thickness that increases the farther the wall is from an exit of the at least one nozzle, wherein a lower portion of the at least one nozzle encloses a space that has a cross-sectional area that decreases toward the exit of the at least one nozzle, and an upper portion of the at least one nozzle encloses a space that has a constant cross-sectional area and extends from the lower portion of the at least one nozzle toward the exit of the at least one nozzle, and wherein an inner wall of the lower portion of the at least one nozzle is inclined at an angle with respect to a surface of the body, the surface of the body being a top surface of the body surrounding the at least one nozzle, an outer wall of the at least one nozzle is inclined at an angle with respect to the surface of the body, and the angle formed by the outer wall of the at least one nozzle and the surface of the body is smaller than an angle formed by the inner wall of the lower portion of the at least one nozzle and the surface of the body.

2. The nozzle plate of claim 1, wherein the body includes silicon with a <100> crystal direction.

3. The nozzle plate of claim 2, wherein the inner wall of the lower portion of the at least one nozzle includes four (111) crystal planes that are inclined at an angle of about 54.7° with respect to a (100) crystal plane.

4. The nozzle plate of claim 1, wherein an inner wall of the at least one nozzle has one of a circular cross-section or a polygonal cross-section.

5. The nozzle plate of claim 1, wherein an outer wall of the at least one nozzle has a circular cross-section or a polygonal cross-section.

6. The nozzle plate of claim 1, further comprising:

protrusion portions on both sides of the body.

* * * * *